US008642520B2

(12) United States Patent
Aguilar et al.

(10) Patent No.: US 8,642,520 B2
(45) Date of Patent: Feb. 4, 2014

(54) SILICONE BASED LUBRICANT COMPOSITIONS

(75) Inventors: Gaston A. Aguilar, Milford, CT (US); Francis S. Cheng, West Hartford, CT (US); Ronald J. Tepper, Fairfield, CT (US)

(73) Assignee: Vanderbilt Chemicals, LLC, Norwalk, CT (US)

( * ) Notice: Subject to any disclaimer, the term of this patent is extended or adjusted under 35 U.S.C. 154(b) by 328 days.

(21) Appl. No.: 13/172,151

(22) Filed: Jun. 29, 2011

(65) Prior Publication Data

US 2012/0004151 A1 Jan. 5, 2012

Related U.S. Application Data

(60) Provisional application No. 61/360,264, filed on Jun. 30, 2010.

(51) Int. Cl.
*C10M 155/02* (2006.01)
*C10M 129/72* (2006.01)

(52) U.S. Cl.
USPC ..... 508/207; 508/486; 508/556

(58) Field of Classification Search
USPC ..... 508/207, 486, 556
See application file for complete search history.

(56) References Cited

U.S. PATENT DOCUMENTS

| | | | | | |
|---|---|---|---|---|---|
| 3,396,111 | A | * | 8/1968 | Smith et al. | 508/496 |
| 4,097,393 | A | | 6/1978 | Cupper et al. | |
| 4,129,508 | A | | 12/1978 | Friihauf | |
| 4,244,831 | A | | 1/1981 | Cupper | |
| 4,374,742 | A | | 2/1983 | Evans et al. | |
| 4,438,022 | A | * | 3/1984 | Campbell | 508/559 |
| 4,519,927 | A | * | 5/1985 | Seiki | 508/214 |
| 5,652,201 | A | * | 7/1997 | Papay et al. | 508/228 |
| 5,773,391 | A | * | 6/1998 | Lawate et al. | 508/257 |
| 5,789,354 | A | | 8/1998 | Mikami et al. | |
| 5,853,435 | A | | 12/1998 | Avery et al. | |
| 5,942,475 | A | * | 8/1999 | Schlosberg et al. | 508/492 |
| 7,399,734 | B2 | | 7/2008 | Grabowski et al. | |
| 7,727,941 | B2 | | 6/2010 | Morrison et al. | |
| 2002/0173431 | A1 | | 11/2002 | Hirata | |
| 2007/0066496 | A1 | | 3/2007 | Morrison et al. | |
| 2010/0081588 | A1 | | 4/2010 | Yamaguchi et al. | |
| 2010/0137454 | A1 | | 6/2010 | Barmes et al. | |

OTHER PUBLICATIONS

International Search Report Dated Oct. 26, 2011, Mailed Nov. 14, 2011.

* cited by examiner

*Primary Examiner* — Jim Goloboy
(74) *Attorney, Agent, or Firm* — Norris McLaughlin & Marcus P.A.

(57) ABSTRACT

Compositions comprising silicone fluids are formulated to provide improved metal-to-metal lubrication. Such Lubricating compositions comprise a major amount of (1) one or more siloxane polymer ("silicone fluids") selected from dimethyl siloxane polymers (also known as dimethyl silicone) and/or phenylmethyl dimethyl siloxane copolymers (also known as phenyl silicone), and lesser amounts of (2) synthetic and/or bio-based ester co-fluid, and (3) an alkoxylated aliphatic polyamine derivative. Unexpectedly, the compositions show a significant improvement in metal-to-metal lubrication, performing better than either the silicone fluids alone or and a combination of silicone with-ester and or silicone with-alkoxylated aliphatic polyamine combinations.

17 Claims, No Drawings

SILICONE BASED LUBRICANT COMPOSITIONS

FIELD OF INVENTION

Silicone fluids are typically used for various lubricating applications with exception of metal-to-metal lubrication due to their poor performance. We have now discovered that compositions comprising silicone fluids can be formulated to provide improved metal-to-metal lubrication. Such lubricating compositions comprise a major amount of (1) one or more siloxane polymer ("silicone fluids") selected from dimethyl siloxane polymers (also known as dimethyl silicone) and phenylmethyl dimethyl siloxane copolymers (also known as phenyl silicone), and lesser amounts of (2) synthetic and/or natural/non-synthetic ester co-fluid, and (3) an alkoxylated aliphatic polyamine derivative. Unexpectedly, the compositions show a significant improvement in metal-to-metal lubrication, performing better than either the silicone fluids alone or a combination of silicone with ester or silicone with alkoxylated aliphatic polyamine.

BACKGROUND

Dimethyl and phenyl silicones are useful lubricating fluids due to their heat stability and their low change in viscosity and volatility with temperature. However, these silicone fluids provide little lubricity to metal-to-metal interfaces and thus, their use is limited to the lubrication of metal-to-plastic interfaces, plastic-to-plastic interfaces and/or application operating under high speeds and light loads.

To improve the lubricity of dimethyl silicone fluids, inventors of U.S. Pat. No. 4,097,393 and U.S. Pat. No. 4,244,831 resorted to combining silicone fluid with hydrocarbon fluids, specifically naphthenic mineral oils, branched chain hydrocarbons, alkylated aromatic oils and synthetic poly alpha-olefins (PAO). However, neither patent taught the use of combinations of silicone fluids with synthetic or bio-based esters and/or alkoxylated aliphatic polyamine derivatives.

U.S. Pat. No. 7,399,734, teaches lubricating oil compositions comprising lubricating oil and a property-wear-improving amount of highly functionalized polymethylsiloxanes additives containing terminal or side chain residues derived from carboxylic acid esters, polyethers, thio groups and/or silanes. However, this patent does not address the problem of improving metal-to-metal lubrication of unfunctionalized dimethyl or phenyl silicone fluids.

SUMMARY

The novel invention relates to lubricating composition comprising (1) about 62% to about 80% (wt/wt) dimethyl and/or phenyl silicone fluids, (2) about 10% to about 30% (wt/wt) synthetic and/or natural ester fluids and (3) about 2.5% to about 12% of alkoxylated aliphatic polyamine derivatives. Unexpectedly, the lubricating compositions significantly improve wear properties compared to compositions comprising silicones without ester and without polyamine, compositions comprising silicone and ester without polyamine, and compositions comprising silicone and polyamine without ester.

Preferred ranges in % (wt/wt) include from about 65% to about 75% of silicone (1), about 15% to about 25% of ester (2), and about 5% to about 10% of polyamine (3). Most preferred range is from about 70% to about 73% of silicone (1), about 18% to about 20% of ester (2), and about 8% to about 9% of polyamine (3).

| Range | Silicone, % | Ester, % | Alkoxylated polyamine, % |
|---|---|---|---|
| General | 62-80 | 10-30 | 2.5-12 |
| Preferred | 65-75 | 15-25 | 5-10 |
| Most preferred | 70-73 | 18-20 | 8-9 |

DETAILED DESCRIPTION

We have recently found that the combination of alkoxylated aliphatic polyamine derivatives, with synthetic and/or bio-based ester fluids shows synergy in improving the lubricity/wear characteristics of dimethyl and/or phenyl silicone fluids at metal-to-metal interfaces. Lubricating compositions described herein may also be combined with typical lubricating base stocks as set forth in U.S. Pat. No. 7,399,734, incorporated herein by reference.

Dimethyl and phenyl silicone fluids are of the following respective formulas:

FI

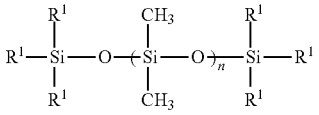

FII

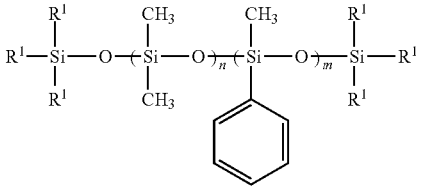

wherein $R^1$ groups are independently selected from alkyl and/or aryl. $R^1$ may be exclusively selected from alkyl. If $R^1$ is alkyl it preferably is methyl.

Phenyl silicones are typically 10 to 90% phenyl substituted and the silicone fluids typically have the physical and chemical characteristics as shown in Table A below:

TABLE A

| Silicone Fluid | Degree polymerization (n or n + m) | Molecular Weight, (Daltons) | Viscosity at 40° C., (cSt) |
|---|---|---|---|
| Dimethyl silicone | 20-30,000 | 1,500-100,000 | 15-45,000 |
| Phenyl silicone | 70-500 | 5,600-40,000 | 40-700 |

The alkoxylated aliphatic polyamine derivative may be chosen from among the following compounds:

FIII

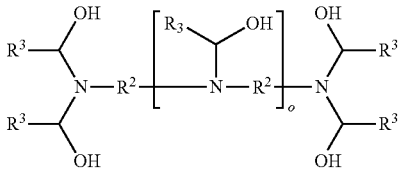

wherein $R^2$ is linear and/or branched $C_2$-$C_{12}$ aliphatic; $R^3$ is independently selected from one of $C_1$-$C_{20}$ alkyl; and o is 0-3.

These polyamine derivatives can be produced from ring opening reactions of polyamines such as ethylene diamine, diethylene diamine, triethylene tetraamine, tetraethyelene pentaamine, pentaethylene hexaamine, 1,3-diaminopropane, hexamethylenediamine, 1,5-pentanediamine, N-(3-aminopropyl)butane-1,4-diamine, N,N'-bis(3-aminopropyl)butane-1,4-diamine, and amine terminated polyalkylene glycols, also known in the industry as JEFFAMINE Polyetheramines® produced by Huntsman Corporation, with epoxides such as epoxyethane, 1,2 epoxypropane, 1,2-epoxybutane and 1,2-epoxy-3-phenoxypropane. Useful polyamines include 2-hydroxyalkyl ethylenediamine derivatives, for example, without limitation, tetrabutoxyethylenediamine, which is a reaction product of ethylene diamine with 4 equivalents of 1,2 epoxybutane.

Synthetic esters useful in the present invention are the mono- di-, tri- or polyesters of mono-, di-, and polycarboxylic acids reacted with mono alcohols or polyols. Polyols are alcohols containing more than one hydroxyl group. The mono-, di-, and polycarboxylic acids typically contain from about 4 to about 24 carbon atoms, while the mono alkanol and polyols typically contain from about 1 to 18 carbon atoms.

Esters include esters of mono- and di-basic carboxylic acids with mono alkanols. These mono- and di-basic carboxylic acids include, without limitation, hexadecanoic acid, heptadecanic acid, phthalic acid, succinic acid, alkyl succinic acid, alkenyl succinic acid, maleic acid, azelaic acid, suberic acid, sebacic acid, fumaric acid, adipic acid, linoleic acid, linoleic acid dimer, polmitic acid, stearic acid, malonic acid, alkyl malonic acid, and alkenyl malonic acid. The mono alkanols include linear or branched alcohols, for example, without limitation, butyl alcohol, hexyl alcohol, dodecyl alcohol, 2-ethylhexyl alcohol, isooctyl alcohol, decyl alcohol, isodecyl alcohol, and tri-isodecyl alcohol. Examples of these esters include, without limitation, nonyl heptanoate, dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, diisooctyl adipate, di-tridecyladipate, and ethylhexyl stearate.

Other useful synthetic esters include polyol esters obtainable by reacting one or more polyhydric alcohol, with one or more linear and/or branched chain alkanoic acid. Polyhydric alcohol include, without limitation, hindered polyols such as the neopentyl polyols, for example, neopentyl glycol, trimethylol ethane, trimethylol propane, 2-methyl-2 propyl-1,3-propanediol, pentaerythritol, and dipentaerythritol.

The alkanoic acids contain at least 4 carbon atoms, typically 5 to 30 carbon atoms and include, for example, caprylic acid, capric acid, lauric acid, myristic acid, polmitic acid, stearic acid, arachic acid, behenic acid, octanoic acid, isooctanoic acid, nanoic acid, decanoic acid, dodecanoic acid, oleic acid and mixtures of one or more of these acids.

Other useful synthetic esters are derived from hydroxy polycarboxylic acids, for example, malic acid, tartaric acid and citric acid. The carboxylic acids of hydroxy polycarboxylic acids are esterfied with one or more linear or branched alcohol, for example, without limitation, butyl alcohol, hexyl alcohol, dodecyl alcohol, 2-ethylhexyl alcohol, isooctyl alcohol, decyl alcohol, isodecyl alcohol, tri-isodecyl alcohol. Hydroxyl groups of hydroxy polycarboxylic acids are esterfied with one or more acid, for example acetic acid, butyric acid, pentanoic acid, hexanoic acid, heptanoic acid, octanoic acid, nonanoic acid, decanoic acid, dodecanoic acid, hexadecanoic acid, heptadecanic acid, phthalic acid, succinic acid, alkyl succinic acid, alkenyl succinic acid, maleic acid, azelaic acid, suberic acid, sebacic acid, fumaric acid, adipic acid, linoleic acid, linoleic acid dimer, polmitic acid, stearic acid, malonic acid, alkyl malonic acid, and alkenyl malonic acid.

Bio-based esters as defined herein are derived from natural sources/formed by living organisms rather than chemically/enzymatically synthesized, may optionally be chemically modified, and include, without limitation, vegetable oils in form of triglyceride mixtures:

FIV

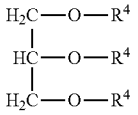

wherein $R^4$ is a fatty acid residue independently selected from a C6, C8, C10, C12, C14, C16, C18, C20, C22, C24 and C26 fatty acid. Examples and common names are indicated in table B below. Examples of vegetable oil sources include corn, cottonseed, safflower, soybean, sunflower and rapeseed (Canola).

TABLE B

| COMMON NAME | SYSTEMATIC NAME | CARBON NUMBER | UN-SATU-RATION |
|---|---|---|---|
| Caprylic acid | Octanoic acid | 8 | 0 |
| Capric acid | Decanoic acid | 10 | 0 |
| Lauric acid | Dodecanoic acid | 12 | 0 |
| Myristic acid | Tetradecanoic acid | 14 | 0 |
| Palmitic acid | Hexadecanoic acid | 16 | 0 |
| Palmitoleic acid | -cis-9-Hexadecenoic acid | 16 | 1 |
| Stearic acid | Octadecanoic acid | 18 | 0 |
| Oleic acid | cis-9-Octadecenoic acid | 18 | 1 |
| Linoleic acid | cis-9-cis-12-Octadecadienoic acid | 18 | 2 |
| Linolenic acid | cis-9-cis-12-cis-15-Octadecatrienoic acid | 18 | 3 |
| Gondoic acid | cis-9-eicosenoic acid | 20 | 1 |
| Erucic acid | cis-13-Docosenoic acid | 22 | 1 |

Vegetable oils can be chemically modified to reduce polyunsaturation that reduces resistance to oxidative and thermal breakdown. Alternatively the oil can be harvested from plant sources genetically modified to reduce polyunsaturation. In reducing polyunsaturation, the oleic acid content of vegetable oils is increased to above 60 percent (wt/wt). For lubricating applications, vegetable oils with high oleic contents (>60 mass percent) are useful.

Alternatively, vegetable oils can be oligomerized to reduce unsaturation and increase carbon number. Oligomerization has the desired effect of increasing oxidation stability and viscosity of vegetable oils and typically occurs by when unsaturated fatty acids of triglycerides react or combine via the double bonds in their structures to form dimers, trimers, etc. Oligomerization of vegetable oil is described in U.S. Pat. Nos. 7,960,596 and 7,960,597, incorporated herein by reference.

The lubricating composition may contain additional ingredients including the following:

Antioxidants
Friction modifiers
Extreme pressure additives
Antiwear additives
Corrosion inhibitors
Rust inhibitors Antioxidant may be used in the compositions of the present invention, if desired. Typical antioxidants include hindered phenolic antioxidants, secondary aromatic amine antioxidants, hindered amine antioxidants, sulfurized phenolic antioxidants, oil-soluble copper compounds, phosphorus-containing antioxidants, organic sulfides, disulfides and polysulfides and the like.

Illustrative sterically hindered phenolic antioxidants include orthoalkylated phenolic compounds such as 2,6-di-tert-butylphenol, 4-methyl-2,6-di-tert-butylphenol, 2,4,6-tri-tert-butylphenol, 2-tert-butylphenol, 2,6-disopropylphenol, 2-methyl-6-tert-butylphenol, 2,4-dimethyl-6-tert-butylphenol, 4-(N,N-dimethylaminomethyl)-2,8-di-tert-butylphenol, 4-ethyl-2,6-di-tert-butylphenol, 2-methyl-6-styrylphenol, 2,6-distyryl-4-nonylphenol, and their analogs and homologs. Mixtures of two or more such mononuclear phenolic compounds are also suitable.

Other preferred phenol antioxidants for use in the compositions of this invention are methylene-bridged alkylphenols, and these can be used singly or in combinations with each other, or in combinations with sterically hindered un-bridged phenolic compounds. Illustrative methylene-bridged compounds include 4,4'-methylenebis(6-tert-butyl o-cresol), 4,4'-methylenebis(2-tert-amyl-o-cresol), 2,2'-methylenebis(4-methyl-6-tert-butylphenol), 4,4'-methylenebis(2,6-di-tert-butylphenol) and similar compounds. Particularly preferred are mixtures of methylene-bridged alkylphenols such as are described in U.S. Pat. No. 3,211,652, which is incorporated herein by reference.

Amine antioxidants, especially oil-soluble aromatic secondary amines may also be used in the compositions of this invention. Although aromatic secondary monoamines are preferred, aromatic secondary polyamines are also suitable. Illustrative aromatic secondary monoamines include diphenylamine, alkyl diphenylamines containing 1 or 2 alkyl substituents each having up to about 16 carbon atoms, phenyl-.beta.-naphthylamine, phenyl-p-naphthylamine, alkyl- or aralkyl-substituted phenyl-.beta.-naphthylamine containing one or two alkyl or aralkyl groups each having up to about 16 carbon atoms, alkyl- or aralkyl-substituted phenyl-p-naphthylamine containing one or two alkyl or aralkyl groups each having up to about 16 carbon atoms, and similar compounds.

A preferred type of aromatic amine antioxidant is an alkylated diphenylamine of the general formula:

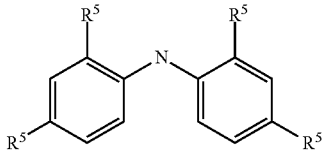

where $R_5$ groups are hydrogen and alkyl groups (preferably a branched alkyl group) having 8 to 12 carbon atoms, (more preferably 8 or 9 carbon atoms). One such preferred compound is available commercially as Naugalube® 438L, a material which is understood to be predominately a 4,4'-dinonyldiphenylamine (i.e., bis(4-nonylphenyl)(amine)) in which the nonyl groups are branched.

The hindered amines are another type aminic antioxidants that may be used in compositions of this invention with two predominating types, the pyrimidines and piperidines. These are all described in great detail above, and in U.S. Pat. No. 5,073,278, U.S. Pat. No. 5,273,669, and U.S. Pat. No. 5,268,113. Preferred hindered amines include 4-stearoyloxy-2,2,6,6-tetramethylpiperidine and dodecyl-N-(2,2,6,6,-tetramethyl-4-piperidinyl)succinate, sold under the trade names Cyasorb® UV-3853 and Cyasorb® UV-3581 from Cytec, di(2,2,6,6-tetramethylpiperidin-4-yl) sebacate and di(1,2,2,6,6-pentamethylpiperidin-4-yl) sebacate, sold as Songlight® 7700 and Songlight® 2920LQ from Songwon, and bis(1-octyloxy-2,2,6,-tetramethyl-4-piperidyl) sebacate, sold as Tinuvin® 123 by Ciba.

Another useful type of antioxidant for preferred inclusion in the compositions of the invention are one or more liquid, partially sulfurized phenolic compounds such as are prepared by reacting sulfur monochloride with a liquid mixture of phenols—at least about 50 weight percent of which mixture of phenols is composed of one or more reactive, hindered phenols—in proportions to provide from about 0.3 to about 0.7 gram atoms of sulfur monochloride per mole of reactive, hindered phenol so as to produce a liquid product. Typical phenol mixtures useful in making such liquid product compositions include a mixture containing by weight about 75% of 2,6-di-tert-butylphenol, about 10% of 2-tert-butylphenol, about 13% of 2,4,6-tri-tert-butylphenol, and about 2% of 2,4-di-tert-butylphenol. The reaction is exothermic and thus is preferably kept within the range of about 15° C. to about 70° C., most preferably between about 40° C. to about 60° C.

Another useful type of antioxidant are 2,2,4-trimethyl-1,2-dihydroquinoline (TMDQ) polymers and homologs containing aromatized terminal units such as those described in U.S. Pat. No. 6,235,686, which is hereby incorporated by reference.

Friction modifiers, which are well known in the art, may be used in the compositions of the present invention. A useful list of friction modifiers is included in U.S. Pat. No. 4,792,410, which is incorporated herein by reference. U.S. Pat. No. 5,110,488 discloses metal salts of fatty acids and especially zinc salts and is incorporated herein by reference. Useful friction modifiers include fatty phosphites, fatty acid amides, fatty epoxides, borated fatty epoxides, fatty amines, glycerol esters, borated glycerol esters alkoxylated fatty amines, borated alkoxylated fatty amines, metal salts of fatty acids, sulfurized olefins, fatty imidazolines, molybdenum dithiocarbamates (e.g., U.S. Pat. No. 4,259,254, incorporated herein by reference), molybdate esters (e.g., U.S. Pat. No. 5,137,647 and U.S. Pat. No. 4,889,647, both incorporated herein by reference), molybdate amine with sulfur donors (e.g., U.S. Pat. No. 4,164,473 incorporated herein by reference), and mixtures thereof.

Extreme pressure additives, which are well known in the art, may be used in the compositions of the present invention. Typical extreme pressure additives are metal-free sulfur compounds, which include but is not limited to, sulfurized lard, sulfurized fish oil, sulfurized whale oil, sulfurized soybean oil, sulfurized pinene oil, sulfurized sperm oil, sulfurized fatty acids and other derivatives derived from oils and fats whose double bonds are sulfurized, as well as elementary sulfur, organic mono- or poly-sulfides, sulfides of isobutylene and other polyolefins, mercaptans, 1,3,4-thiadiazole derivatives, thiuram disulfides, dithiocarbamates and the like. Comprehensive listing of these additives is provided in U.S. Pat. No. 6,245,725.

Extreme pressure additives may also be metal containing and typically include carboxylates, dithiocarbamates and dithiophosphates and preferred metals are bismuth, antimony and molybdenum.

Antiwear agents, which are well known in the art, may be used in the compositions of the present invention. Additive compositions of this invention can include organophosphorus compounds as antiwear additives. These compounds are selected from a group consisting of phosphates, acid phosphates, amine phosphates, metal dithiophosphates, amine thiophosphates, reaction products of dithiophosphates with unsaturated compounds, phosphites, acid phosphites, phosphonates, phosphonic acids, acid phosphonates, amine phosphonates and mixtures all of the above.

Phosphates and acid phosphates of the invention are of the following general formula:

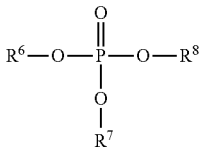

wherein $R_6$, $R_7$ and $R_8$ represent aliphatic s having 1 to 30 carbon atoms and/or hydrogen and all R groups are aliphatic for phosphates and one or two of the R groups are aliphatic for acid phosphates. As per U.S. Pat. Nos. 3,019,249 and 6,962,895 herein incorporated as references, acid phosphates of this invention are prepared by reacting a phosphorus source with least one alcohol, phenol and/or alkylated phenol. The best known phosphorus source is phosphorus pentaoxide, $P_2O_5$, which reacts with 3 equivalents of alcohol, phenol and/or alkylated phenol to produce a mixture of mono- and di-substituted acid phosphates. Another common phosphorus source is phosphorus oxychloride, $POCl_3$, which can react with 3 or less equivalents of alcohol, phenol and/or alkylated phenols to produce phosphates or mixtures of chlorophosphates that are hydrolyzed to mixtures of mono- and di-substituted acid phosphates. Alcohols for these reactions can be methyl, propyl, butyl, amyl, 2-ethylhexyl, hexyl, octyl, and oleyl alcohols. Examples of commercially available alcohols are also provided in column 17, line 35 to column 18, line 5 of U.S. Pat. No. 6,962,895. Phenols for these reactions are ortho-cresol, meta-cresol, para-cresol and mixtures thereof. As per U.S. Pat. No. 3,019,249, acid phosphates of this invention are also prepared by the reaction of trisubstituted phosphates with phosphoric acid. In reactions, R groups can be alkyl, substituted alkyl, aryl, substituted aryl and mixtures thereof.

Amine phosphates of the invention are formed when acid phosphates are reacted with ammonia, amines or mixtures thereof to produce compounds of the following general formula:

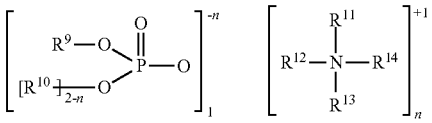

wherein $R^9$ represents an aliphatic group having 1 to 30 carbon atoms; $R^{10}$ represents hydrogen or aliphatic groups having 1 to 30 carbon atoms; $R_{11}$, $R_{12}$, $R_{13}$ and $R_{14}$ independently represent hydrogen or hydrocarbyl groups in which at least one of the R groups is hydrogen and n is an integer of 1 or 2. The amines used to form the ammonium moiety can be monoamines and polyamines. Useful amines are disclosed in column 22, line 35 to column 28, line 35 of U.S. Pat. No. 6,642,187. Preferred amine composition is a mixture of $C_{11}$-$C_{14}$ tertiary alkyl primary monoamines known as "Primene 81R" manufactured by Rohm and Haas Company.

Metal dithiophosphates of the invention are the following formula:

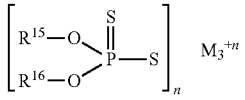

wherein $R_{15}$ and $R_{16}$ independently represent aliphatic groups having 3 to 22 carbon atoms, and $M_3$ represent metals of the periodic table in groups IIA, IIIA, VA, VIA, IB, IIB, VIB, or VIII. Metal dithiophosphates are prepared by reaction of metal bases with one or more dithiophosphoric acids. The metal bases can be any metal compound capable of forming a metal salt. Examples of metal bases include metal oxides, hydroxides, carbonates, and sulfates. The preferred metal base is zinc oxide. The dithiophosphoric acids are prepared by reaction of phosphorus sulfides, which includes phosphorus pentasulfide, phosphorus sequisulfide, and phosphorus heptasulfide with one or more alcohols. Examples of alcohols include isopropyl, isobutyl, n-butyl, sec-butyl, amyl, n-hexyl, methylisobutyl carbinyl, heptyl, 2-ethylhexyl, isooctyl, nonyl, decyl, dodecyl, tridecyl and alkylphenyl alcohols.

Amine thiophosphates of the invention are formed when dithiophosphoric acids or monothiophoshoric acids are reacted with ammonia, amines or mixtures thereof to produce compounds of the following general formula:

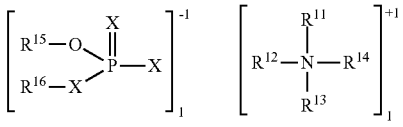

wherein X atoms independently represent O and S, $R_{15}$ and $R_{16}$ independently represent aliphatic groups having 3 to 22 carbon atoms, and $R_{11}$, $R_{12}$, $R_{13}$ and $R_{14}$ independently represent hydrogen or hydrocarbyl groups in which at least one of the R groups is hydrogen. The dithiophosphoric acids are prepared by reaction of phosphorus sulfides, which includes phosphorus pentasulfide, phosphorus sequisulfide, and phosphorus heptasulfide with one or more alcohols. Examples of alcohols include isopropyl, isobutyl, n-butyl, sec-butyl, amyl, n-hexyl, methylisobutyl carbinyl, heptyl, 2-ethylhexyl, isooctyl, nonyl, decyl, dodecyl, tridecyl and alkylphenyl alcohols. The monothiophoshoric acids are typically prepared by the reaction of a sulfur source with a dihydrocarbyl phosphite. Examples of useful sulfur sources include elemental sulfur, sulfur halides, combinations of sulfur or sulfur oxides with hydrogen sulfide, and various sulfurized organic compounds. Elemental sulfur is a preferred sulfur source. The preparations of monothiophosphoric acids are disclosed in U.S. Pat. No. 4,755,311 and PCT Publication WO 87/07638, which are incorporated herein by reference for their disclosure of monothiophosphoric acids, sulfur sources, and the process for making monothiophosphoric acids. The amines used to form the ammonium moiety can be monoamines and polyamines. Useful amines are disclosed in column 22, line 35 to column 28, line 35 of U.S. Pat. No. 6,642,187. Preferred amine composition is a mixture of $C_{11}$-$C_{14}$ tertiary alkyl primary monoamines known as "Primene 81R" manufactured by Rohm and Haas Company.

Reaction products of dithiophosphates with unsaturated compounds to produce compounds of the following formula:

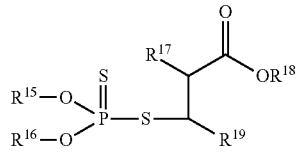

wherein $R_{15}$ and $R_{16}$ independently represent aliphatic groups having 3 to 22 carbon atoms, $R_{17}$ represents hydrogen or methyl, $R_{18}$ represents hydrogen or alkyl groups having 1 to 18 carbons or alcohol substituted alkyl groups having 1 to 18 carbons and $R_{19}$ represents hydrogen, carboxylic acid (—$CO_2H$) or carboxylic acid ester (—$CO_2R$) in which R is an alkyl group having 1 to 8 carbons. Examples useful in the present invention are acrylic acid, methacrylic acid, methyl acrylate, ethyl acrylate, 2-ethylhexyl acrylate, ethyl methacrylate, 2-hydroxyethylmethacrylate, ethyl maleate, butyl maleate, and 2-ethylhexyl maleate.

Acid phosphites of the invention are dihydrocarbyl phosphite of the following formula:

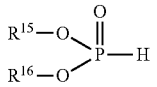

wherein $R_{15}$ and $R_{16}$ independently represent aliphatic groups having 3 to 22 carbon atoms. Preferred aliphatic groups are alkyl and various names are used to describe these compounds including dialkyl hydrogen phosphite, bis(hydroxyalkyl)phosphine oxide, dialkyloxyphosphine oxide, dialkyl acid phosphite, dialkyl phosphite, O,O-dialkyl phosphonate, dialkyl phosphorous acid, hydrogen dialkyl phosphite, alkyl phosphonate and phosphorous acid dialkyl ester. Dihydrocarbyl phosphite of the invention may be prepared by reaction of phosphorus trichloride with 3 equivalents of alcohol to produce 1 equivalent of desired product along with 1 equivalent of hydrocarbyl halide and 2 equivalents of hydrochloric acid. For high carbon number hydrogen, preferred method of preparation involves exchange reaction between higher carbon number alcohols, phenols or alkylated phenols with dimethyl hydrogen phosphite, which is also known as bis(hydroxymethyl)phosphine oxide, dimethyloxyphosphine oxide, dimethyl acid phosphite, dimethyl phosphite, O,O-dimethyl phosphonate, dimethyl phosphorous acid, hydrogen dimethyl phosphite, methyl phosphonate and phosphorous acid dimethyl ester. This preparation is disclosed in U.S. Pat. No. 5,523,005, which are incorporated herein by reference.

Trialkyl phosphites of the invention are of the following formula:

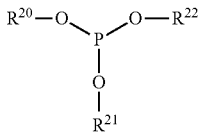

wherein $R_{20}$, $R_{21}$, and $R_{22}$ are aliphatic groups having 3 to 22 carbon atoms. Trialkyl phosphites can be prepared by treating a phosphorus tri-halide with three equivalents of an alcohol and a tertiary amine.

Phosphonates of the invention are of the following formula:

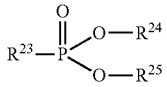

wherein $R_{23}$, $R_{24}$, and $R_{25}$ are hydrocarbyl groups having 3 to 22 carbon atoms. Phosphonates can be made by the Michaelis-Arbuzov reaction in which trialkyl phosphites are treated with alkyl halides, which afford the phosphonate and an alkyl halide as a side product. They can also be produced by treating a trialkyl phosphite with a carboxylic acid derivative such as an acid chloride to form alpha keto phosphonates. Alpha keto phosphonates can be converted to hydroxy methylene bis acid phosphonates of the following formula by reaction with acid phosphites:

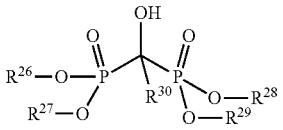

wherein $R_{26}$, $R_{27}$, $R_{28}$, $R_{29}$ and $R_{30}$ represent aliphatic groups having 3 to 22 carbon atoms. Phosphonate can then be completely or partially hydrolyzed to respectively produce phosphonic acids and acid phosphonates wherein $R_{26}$ through $R_{29}$ can be hydrogen, which can then be completely or partially, neutralized with ammonia and/or amines to make amine phosphonates.

Embodiments of rust inhibitors include metal and ammonium salts of sulfonates, fatty acids, fatty amines, salts of fatty acids with ammonia or alkyl amines, alkyl succinic acids, alkyl succinic half esters, fatty imidazole derivatives and mixtures thereof. Useful sulfonates are those produced neutralization dinonylnaphthalene sulfonic acid with basic sources of barium, calcium and zinc sources or with ammonium, alkyl amines or polyamines.

Embodiments of copper corrosion inhibitors that may optionally be added include thiazoles, triazoles and thiadiazoles. Example embodiments of such compounds include benzotriazole, tolyltriazole, octyltriazole, decyltriazole, dodecyltriazole, 2-mercapto-benzothiazole, 2,5-dimercapto-1,3,4-thiadiazole, 2-mercapto-5-hydrocarbylthio-1,3,4-thiadiazoles, 2-mercapto-5-hydrocarbyldithio-1,3,4-thiadiazoles, 2,5-bis(hydrocarbylthio)-1,3,4-thiadiazoles, and 2,5-bis(hydrocarbyldithio)-1,3,4-thiadiazoles.

The inventive lubricating composition may also be used to produce greases. Generally, grease is comprised of 65 to 95 mass percent of a base fluid and 3 to 10 mass percent of thickener system. For this invention, the base fluid will consist of dimethyl and/or phenyl silicone fluids. The most common thickener systems for dimethyl and/or phenyl silicone fluids are lithium soaps, and lithium-complex soaps, which are produced by the neutralization of fatty carboxylic acids or the saponification of fatty carboxylic acid esters with lithium hydroxide typically directly in the base fluids. Lithium-complex greases differ from simple lithium greases by incorporation of a complexing agent, which usually consists of dicarboxylic acids. Other soap based thickener systems known in the art are aluminum, aluminum complex, calcium, and calcium complex, where aluminum source is typically an aluminum alkoxide and calcium source is lime. Useful none soap thickeners that are known in art are organically modified clay and polyurea.

EXAMPLES

Test Methods

The 4-Ball Wear Test (ASTM D-4172) is a standard test that is used to determine a lubricants ability to minimize wear under sliding metal-to-metal contact situations. Smaller wear scars show that a lubricant is providing improved lubricity and wear protection. The 4-Ball Wear Tests are conducted according to the standard procedure described in ASTM D4172. In this test method, one ball is rotated on three evenly spaced static balls while the four balls are completely submerged under the test oil. The tests for the following examples were conducted at a rotation speed of 1800 rpm under a load of 20 kg for one hour at 75° C. unless otherwise indicated. The scar diameter of three static balls is measured and the result is the average of the three.

Example 1

The 4-Ball Wear Tests were performed on lubricant compositions composed of 72 mass percent Dow Corning® 550, a phenyl silicone supplied by Dow Corning Corporation and either (1) 28 mass percent esters or (2) 19 mass percent ester and 9 mass percent tetrabutoxyethylenediamine (TBEDA) as supplied by Dow Chemical Company. The results are shown in Table C, Experiment Nos. 1-19. The compositions comprising (a) silicone, (b) ester and (c) polyamine provided a significantly improved wear protection compared to compositions comprising only (a), (a) and (b), or (a) and (c), thus demonstrating the synergistic effect of using esters and alkoxylated aliphatic polyamine derivatives in silicone fluids.

Example 2

As set forth by Experiment Nos. 20-24 in Table C, 4-Ball Wear Tests were performed on lubricant compositions composed of 72 mass percent Dow Corning® 550 phenylmethyl siloxane, 19 mass percent (wt/wt) Hatcol® 2965 and 9% (wt/wt) alkoxylated aliphatic polyamine derivatives prepared by reacting polyamine with an epoxide or an epoxide mixture. As shown in the table, the compositions comprising (a) silicone, (b) ester and (c) polyamine provided significantly improved wear protection over 2-component compositions of Example 1, thus demonstrating the synergistic effect of using esters and alkoxylated aliphatic polyamine derivatives in silicone fluids.

TABLE C

Data for Examples 1 and 2

| Exp. No. | Ester | % Ester | Amine | % Amine | Scar width (mm) |
|---|---|---|---|---|---|
| 1 | None | 0 | None | 0 | Severe scarring[1] |
| 2 | None | 0 | TBEDA* | 9 | 2.50 |
| 3 | $C_{5-10}$ carboxylic acid esters of pentaerythritol[2] | 28 | None | 0 | 1.65 |
| 4 | $C_{5-10}$ carboxylic acid esters of pentaerythritol[2] | 19 | TBEDA* | 9 | 0.47 |
| 5 | Adipate[3] | 28 | None | 0 | 1.50 |
| 6 | Adipate[3] | 19 | TBEDA* | 9 | 0.69 |
| 7 | Ditridecyl adipate[4] | 28 | None | 0 | 2.30 |
| 8 | Ditridecyl adipate[4] | 19 | TBEDA* | 9 | 0.76 |
| 9 | $C_{9-11}$ branched alkyl phthalates[5] | 28 | None | 0 | 1.33 |
| 10 | $C_{9-11}$ branched alkyl phthalates[5] | 19 | TBEDA* | 9 | 0.75 |
| 11 | diisononyl ester of 1,2-cyclohexane-dicarboxylic acid[6] | 28 | None | 0 | 1.33 |
| 12 | diisononyl ester of 1,2-cyclohexane-dicarboxylic acid[6] | 19 | TBEDA* | 9 | 0.74 |
| 13 | Acetyl tri-n-butyl citrate[7] | 28 | None | 0 | 1.81 |
| 14 | Acetyl tri-n-butyl citrate[7] | 19 | TBEDA* | 9 | 0.68 |
| 15 | Canola Oil[8] | 28 | None | 0 | 1.76 |
| 16 | Canola Oil[8] | 19 | TBEDA* | 9 | 0.72 |
| 17 | Soybean oil[9] | 28 | None | 0 | 1.09 |
| 19 | Soybean oil[9] | 19 | TBEDA* | 9 | 0.78 |
| 20 | $C_{5-10}$ carboxylic acid esters of pentaerythritol[2] | 19 | Reaction of JEFFAMINE ® D-2301** with 4 equivalents of 1,2 epoxypropane | 9 | 0.77 |
| 21 | $C_{5-10}$ carboxylic acid esters of pentaerythritol[2] | 19 | Reaction product of ethylene diamine with 3 equivalents of 1,2-epoxybutane and 1 equivalent of 1,2-epoxy-3-phenoxypropane | 9 | 0.56 |
| 22 | $C_{5-10}$ carboxylic acid esters of pentaerythritol[2] | 19 | Reaction product of diethylenetriamine with 5 equivalents of 1,2-epoxybutane | 9 | 0.47 |

TABLE C-continued

Data for Examples 1 and 2

| Exp. No. | Ester | % Ester | Amine | % Amine | Scar width (mm) |
|---|---|---|---|---|---|
| 24 | $C_{5-10}$ carboxylic acid esters of pentaerythritol[2] | 19 | Reaction product of ethylene diamine with 4 equivalents of 1,2-epoxybutane (TBEDA) | 9 | 0.47 |

All lubricant compositions comprised 72% phenyl silicone, Dow Corning ® 550.

*TBEDA: tetrabutoxyethylenediamine, Dow Corning

**JEFFAMINE ® D-230: primary amine terminated polypropylene oxide with an average molecular weight of about 230 grams/mole, Huntsmen Corporation

[1]Test aborted after 1 minute due to high noise and heat generation

[2]Hatcol ® 2965, Chemtura Inc.

[3]Esterex ™ A32, ExxonMobil Chemical Co.

[4]Esterex ™ A51, ExxonMobil Chemical Co.

[5]Esterex ™ P61, ExxonMobil Chemical Co.

[6]Hexamoll ® DINCH, BASF

[7]Citroflex ® A4, Vertellus ™ Specialities Inc.

[8]Agri-Pure 60, Cargill Inc.

[9]Agri-Pure AR, Cargill Inc.

TABLE C-2

Tradenames of esters and their commercial sources:

| | | |
|---|---|---|
| $C_{5-10}$ carboxylic acid esters of pentaerythritol | Hatcol ® 2965 | Chemtura Inc. |
| Adipate | Esterex ™ A32 | ExxonMobil Chemical Co. |
| Ditridecyl adipate | Esterex ™ A51 | ExxonMobil Chemical Co. |
| $C_{9-11}$ branched alkyl phthalates | Esterex ™ P61 | ExxonMobil Chemical Co. |
| diisononyl ester of 1,2-cyclohexane-dicarboxylic acid | Hexamoll ® DINCH | BASF |
| Acetyl tri-n-butyl citrate | Citroflex ® A4 | Vertellus ™ Specialities Inc. |
| Canola Oil | Agri-Pure 60 | Cargill Inc. |
| Soybean oil | Agri-Pure AR | Cargill Inc. |
| Primary amine terminated polypropylene oxide with an average molecular weight of about 230 grams/mole. It supplied by. | [1]JEFFAMINE ® D-230 | Huntsmen Corporation |

What is claimed is:

1. A lubricating composition comprising (a) about 62% to about 80% (wt/wt) of one or more silicones selected from the group consisting of dimethyl siloxane polymer and phenylmethyl dimethyl siloxane co-polymer, (b) about 10 to 30% (wt/wt) of an ester selected from the group consisting of (i) synthetic esters obtainable by reacting one or more aliphatic and aromatic polycarboxylic $C_{3-24}(COOH)_x$ acid wherein x is 1-3, with one or more $C_{1-18}(OH)_y$ alcohol wherein y is 1-6, to form a hydroxy polycarboxylic acid; and (ii) bio-based esters selected from vegetable oil and oils consisting of one or more triglycerides of formula IV

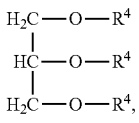

wherein $R^4$ is a fatty acid residue independently selected from the group consisting of caprylic acid, capric acid, lauric acid, myristic acid, palmitic acid, palmitoleic acid, stearic acid, oleic acid, linoleic acid, linolenic acid, gondoic acid, and erucic acid, wherein (ii) is bio-based triglyceride of formula IV wherein >60 mass percent (wt/wt) of the $R^4$ groups are derived from oleic acid, (c) about 2.5% (wt/wt) to about 12% (wt/wt) of an alkoxylated aliphatic polyamine derivative produce by reacting aliphatic polyamines with aliphatic $C_{2-12}$ 1,2 epoxides.

2. The lubricating composition of claim 1 wherein the concentration of the silicone (a) is about 65% (wt/wt) to about 75% (wt/wt), the concentration of the ester (b) is about 15% (wt/wt) to about 25% (wt/wt), and the concentration of the polyamine (c) is about 5% (wt/wt) to about 10% (wt/wt).

3. The lubricating composition of claim 2 wherein the concentration of the silicone (a) is about 70% (wt/wt) to about 73% (wt/wt), the concentration of the ester (b) is about 18% (wt/wt) to about 20% (wt/wt), and the concentration of the polyamine (c) is about 8% (wt/wt) to about 9% (wt/wt).

4. The lubricating composition of claim 1 wherein (b) is a synthetic ester obtainable from reaction of one or more $C_{3-24}(COOH)_x$ polycarboxylic acid wherein x is 1-3.

5. The lubricating composition of claim 4 wherein (b) is a synthetic ester obtainable from reaction of one or more carboxylic acid selected from the group consisting of hexadecanoic acid, heptadecanic acid, phthalic acid, succinic acid, alkyl succinic acid, alkenyl succinic acid, maleic acid, azelaic acid, suberic acid, sebacic acid, fumaric acid, adipic acid, linoleic acid, linoleic acid dimer, polmitic acid, stearic acid, malonic acid, alkyl malonic acid, and alkenyl malonic acid.

6. The lubricating composition of claim 1 wherein (b) is a synthetic ester selected from the group consisting of nonyl heptanoate, dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, di-isooctyl adipate, di-tridecyladipate, ethylhexyl stearate and mixtures thereof.

7. The lubricating composition of claim 1 wherein the alcohol is selected from the group consisting of butyl alcohol, hexyl alcohol, dodecyl alcohol, 2-ethylhexyl alcohol, isooctyl alcohol, decyl alcohol, isodecyl alcohol, and tri-isodecyl alcohol.

8. The lubricating composition of claim 1 wherein (b) is a synthetic polyol ester obtainable by reaction of an aliphatic carboxylic acid with one or more polyhydric alcohols.

9. The lubricating composition of claim 8 wherein the one or more polyhydric alcohol is a hindered polyol independently selected from the group consisting of neopentyl polyols, neopentyl glycols, trimethylol ethane, trimethylol propane, 2-methyl-2 propyl-1,3-propanediol, pentaerythritol, and dipentaerythritol.

10. The lubricating composition of claim 8 wherein the aliphatic carboxylic acid is selected from the group consisting of caprylic acid, capric acid, lauric acid, myristic acid, polmitic acid, stearic acid, arachic acid, behenic acid, octanoic acid, isooctanoic acid, nanoic acid, decanoic acid, dodecanoic acid, oleic acid and mixtures thereof.

11. The lubricating composition of claim 1 wherein the hydroxy polycarboxylic acid is selected from the group consisting of malic acid, tartaric acid, and citric acid.

12. The lubricating composition of claim 1, wherein one or more hydroxyl groups of hydroxy polycarboxylic acids are esterfied with one or more acid selected from the group consisting of acetic acid, butyric acid, pentanoic acid, hexanoic acid, heptanoic acid, octanoic acid, nonanoic acid, decanoic acid, dodecanoic acid, hexadecanoic acid, heptadecanic acid, phthalic acid, succinic acid, alkyl succinic acid, alkenyl succinic acid, maleic acid, azelaic acid, suberic acid, sebacic acid, fumaric acid, adipic acid, linoleic acid, linoleic acid dimer, polmitic acid, stearic acid, malonic acid, alkyl malonic acid, and alkenyl malonic acid.

13. The lubricating composition of claim 1, wherein one or more carboxylic acid groups of hydroxy polycarboxylic acids are esterfied with one or more alcohol selected from the group consisting of butyl alcohol, hexyl alcohol, dodecyl alcohol, 2-ethylhexyl alcohol, isooctyl alcohol, decyl alcohol, isodecyl alcohol, and tri-isodecyl alcohol.

14. The lubricating composition of claim 1 wherein (b) is a vegetable oil selected from the group of oils of corn, cottonseed, safflower, soybean, sunflower and rapeseed (Canola), or a mixture of one or more of these oils.

15. The lubricating composition of claim 1, wherein the bio-based triglyceride of formula IV is oligomerized.

16. The lubricating composition of claim 1 wherein the alkoxylated aliphatic polyamine derivative is produced by reacting ethylene diamine, diethylene diamine, triethylene tetraamine, tetraethyelene pentaamine, pentaethylene hexaamine, 1,3-diaminopropane, hexamethylenediamine, 1,5-pentanediamine, N-(3-aminopropyl)butane-1,4-diamine, N,N'-bis(3-aminopropyl)butane-1,4-diamine, and polyetheramines with aliphatic $C_{2-12}$ 1,2 epoxides.

17. The lubricating composition of claim 1 wherein the alkoxylated aliphatic polyamine derivative is produced by reacting aliphatic polyamines with epoxyethane, 1,2 epoxypropane, 1,2-epoxybutane and 1,2-epoxy-3-phenoxypropane.

* * * * *